US005970765A

United States Patent [19]

Seidel

[11] Patent Number: 5,970,765

[45] Date of Patent: Oct. 26, 1999

[54] METHOD AND APPARATUS FOR ROLLING STRIP

[75] Inventor: Jürgen Seidel, Kreuztal, Germany

[73] Assignee: SMS Schloemann-Siemag Aktiengesellschaft, Düsseldorf, Germany

[21] Appl. No.: 08/994,173

[22] Filed: Dec. 19, 1997

[30] Foreign Application Priority Data

Dec. 23, 1996 [DE] Germany ..... 196 54 068

[51] Int. Cl.[6] ..... B21B 37/28

[52] U.S. Cl. ..... 72/9.1; 72/11.7; 72/365.2

[58] Field of Search ..... 72/241.4, 241.8, 72/247, 8.3, 8.9, 9.1, 9.2, 9.4, 11.2, 11.6, 11.7, 11.8, 12.7, 200–202, 365.2, 41

[56] References Cited

U.S. PATENT DOCUMENTS

| | | | |
|---|---|---|---|
| 5,193,066 | 3/1993 | Konishi et al. . | |
| 5,562,525 | 10/1996 | Mori et al. | 451/5 |
| 5,860,304 | 1/1999 | Anbe et al. | 72/9.1 |

FOREIGN PATENT DOCUMENTS

| | | |
|---|---|---|
| 0276743 | 8/1988 | European Pat. Off. . |
| 0618020 | 10/1994 | European Pat. Off. . |
| 0618020 | 6/1997 | European Pat. Off. . |
| 2640894 | 6/1990 | France . |
| 3038865 | 12/1982 | Germany . |

*Primary Examiner*—Lowell A. Larson
*Assistant Examiner*—Ed Tolan
*Attorney, Agent, or Firm*—Friedrich Kueffner

[57] ABSTRACT

A method of rolling strip in a strip rolling train having at least two roll stands, each roll stand having horizontally adjustable upper and lower work rolls, wherein the work rolls act alone as a two-high stand or each work roll is supported directly or through an intermediate roll by a back-up roll, or in a reversing stand in which at least two passes are rolled, wherein the strip is subjected in the roll stands to a constitutional change, and wherein adjusting elements act on the strip for imparting a profile and surface evenness to the strip. The method includes presupposing in at least one strip area an intended surface unevenness shape over a width of the strip, determining an actually achieved surface unevenness shape in the strip area and comparing the actually achieved surface unevenness shape to the presupposed unevenness shape, computing a difference between the unevenness shapes, and operating the adjusting elements such that the difference is minimized.

18 Claims, 13 Drawing Sheets

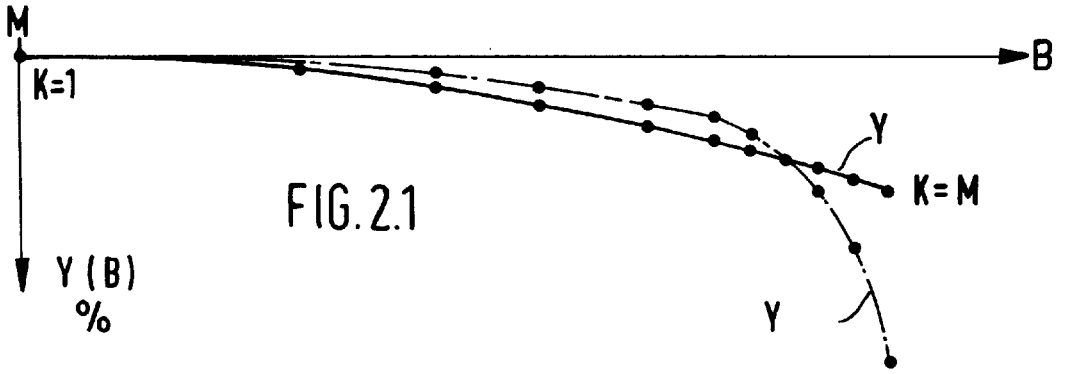
FIG. 2.1
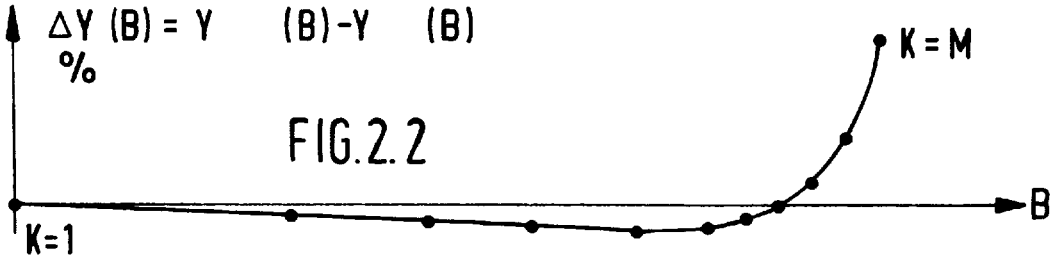
FIG. 2.2
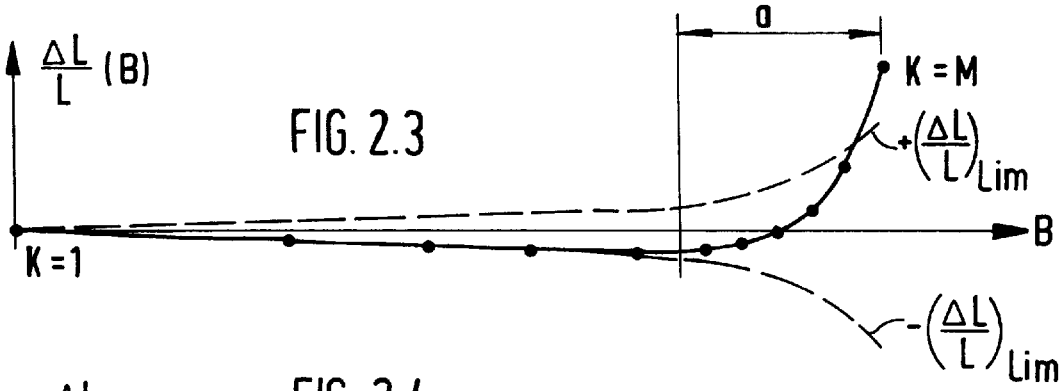
FIG. 2.3
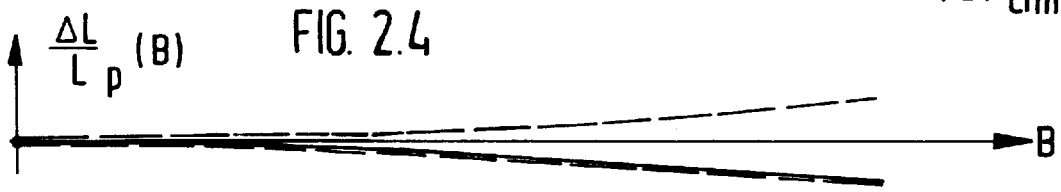
FIG. 2.4
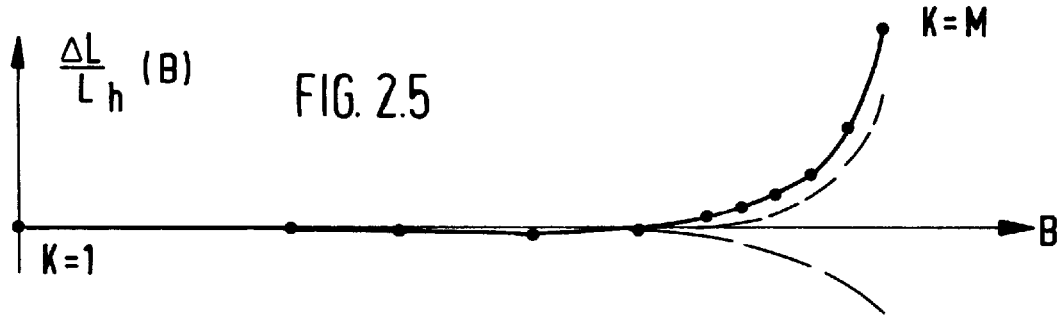
FIG. 2.5

FIG. 3.1
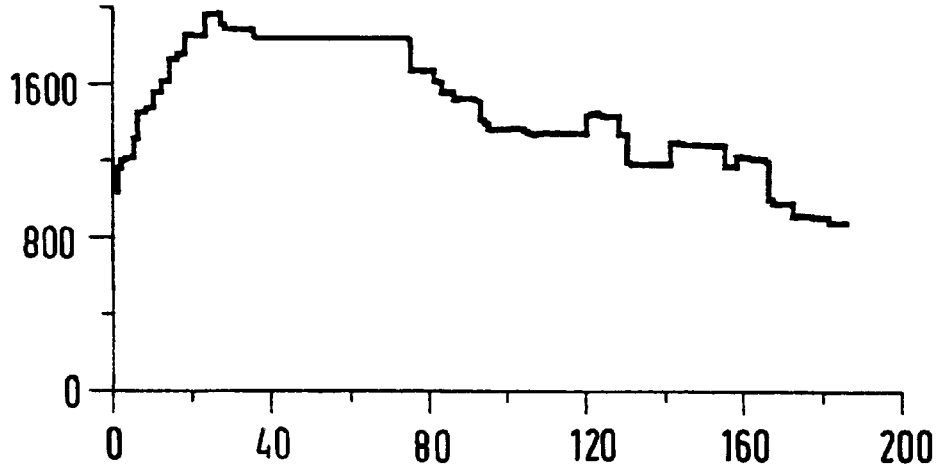
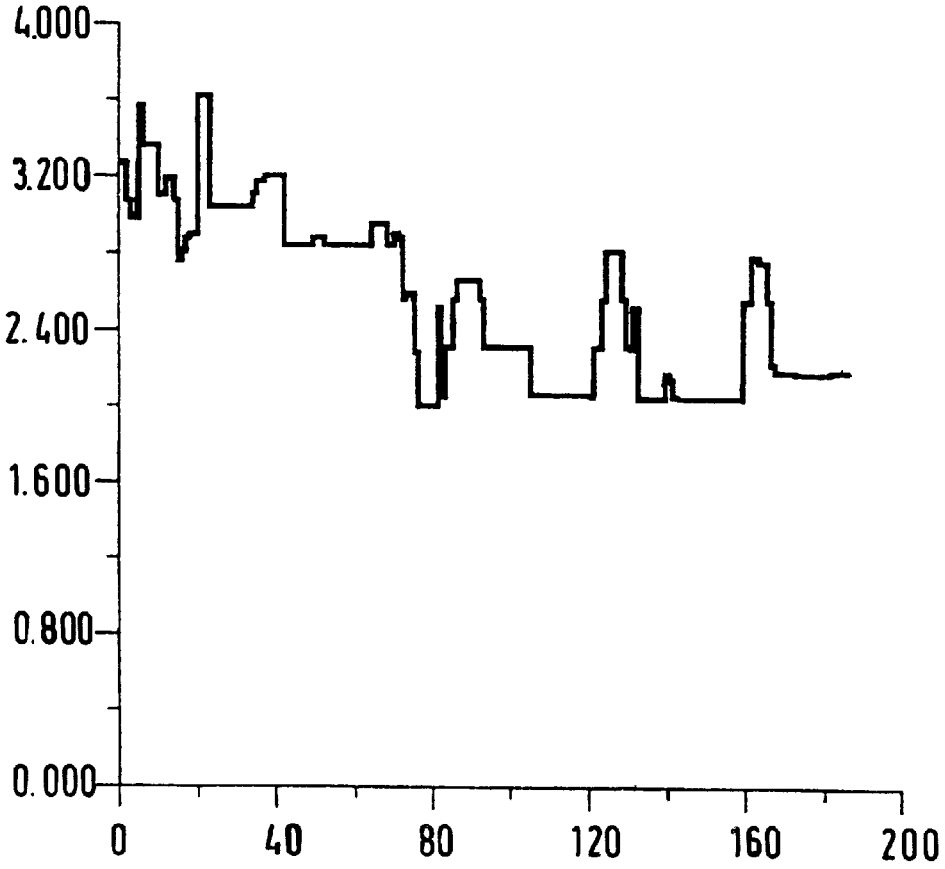
FIG. 3.2

FIG. 5.1
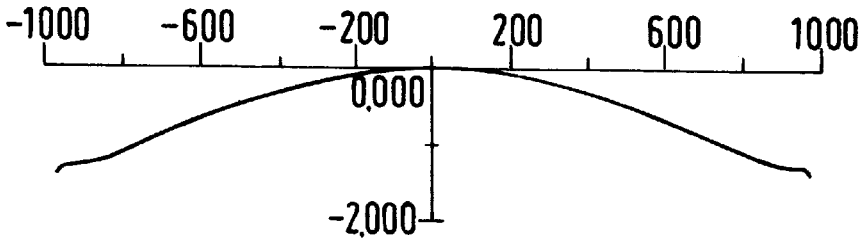
FIG. 5.2
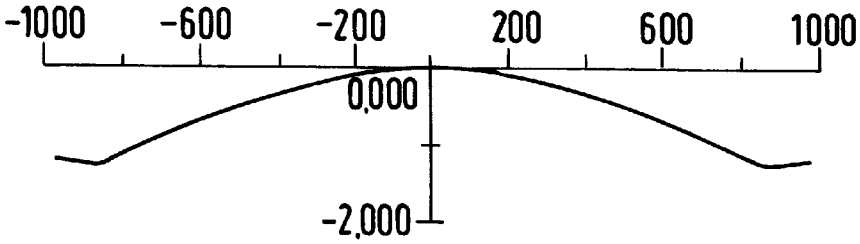
FIG. 5.3
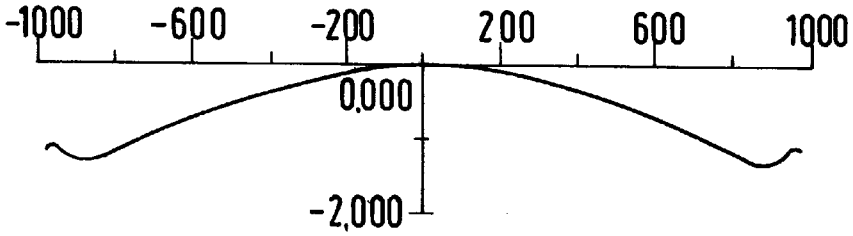
FIG. 5.4
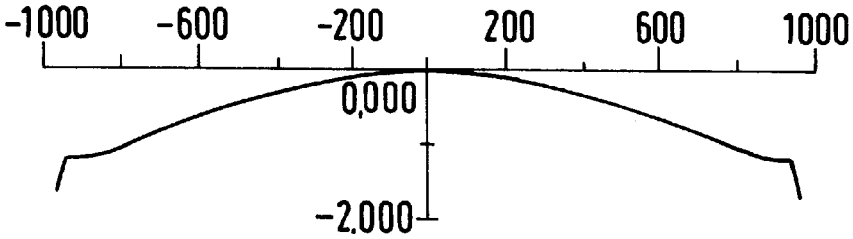
FIG. 5.5
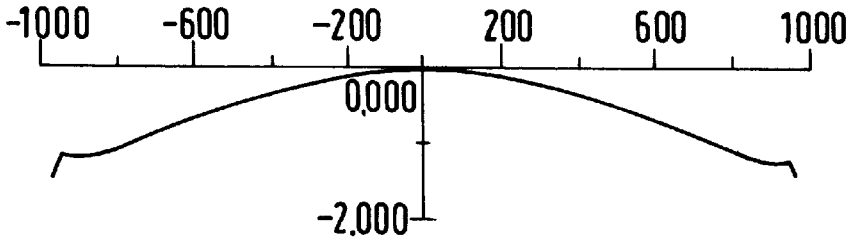
FIG. 5.6
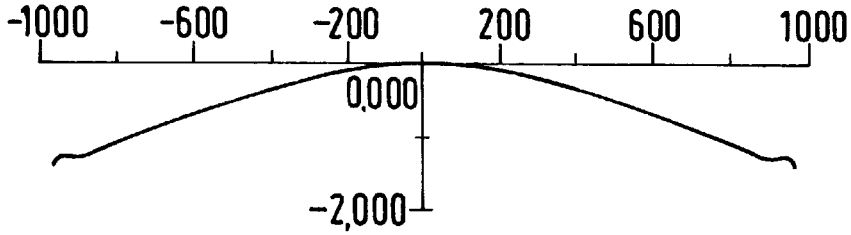

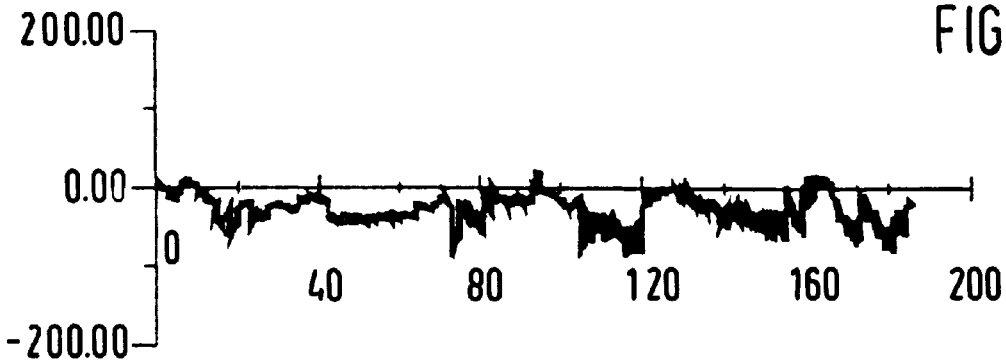
FIG. 6.1
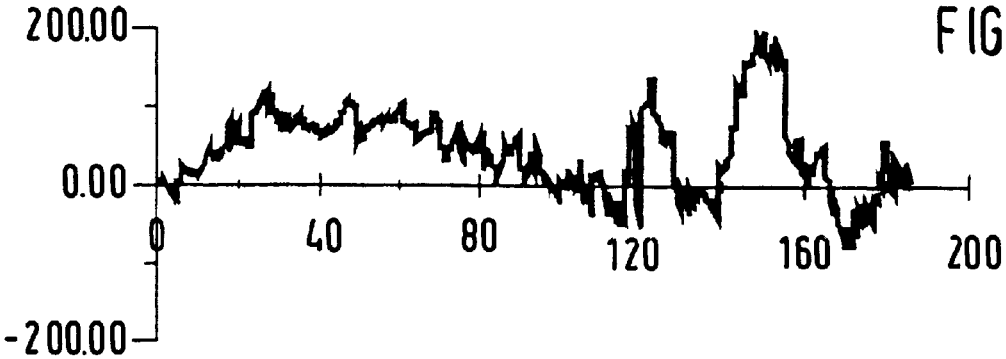
FIG. 6.2
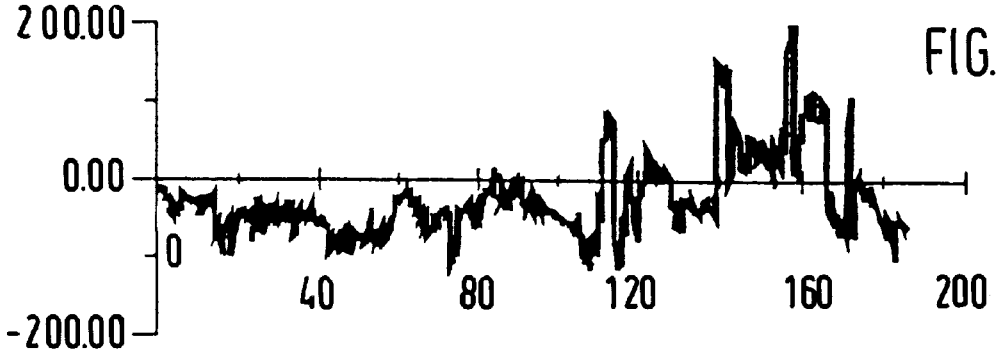
FIG. 6.3
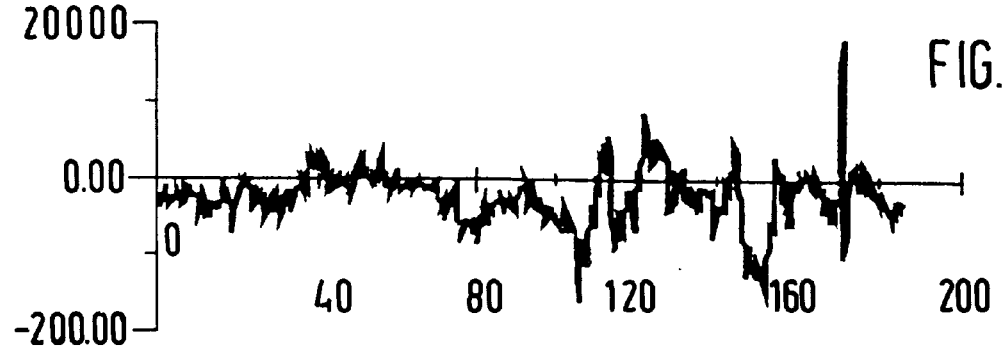
FIG. 6.4

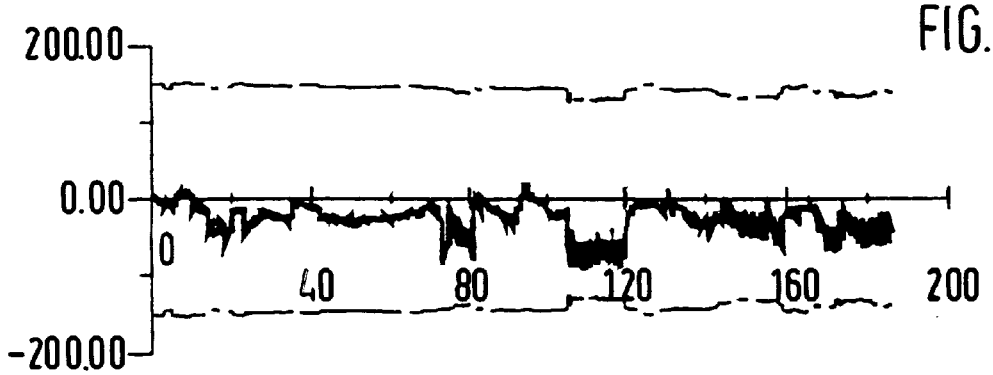
FIG. 7.1
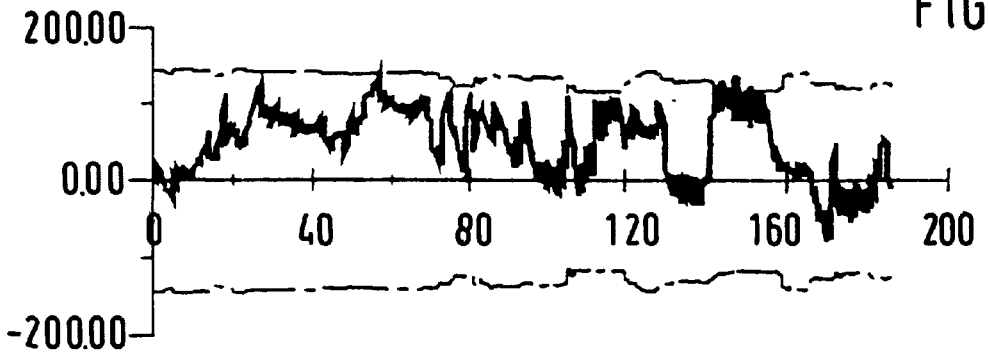
FIG. 7.2
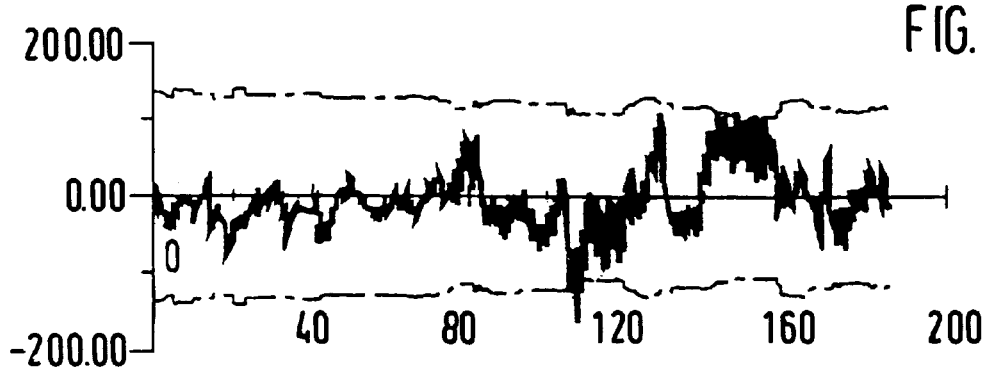
FIG. 7.3
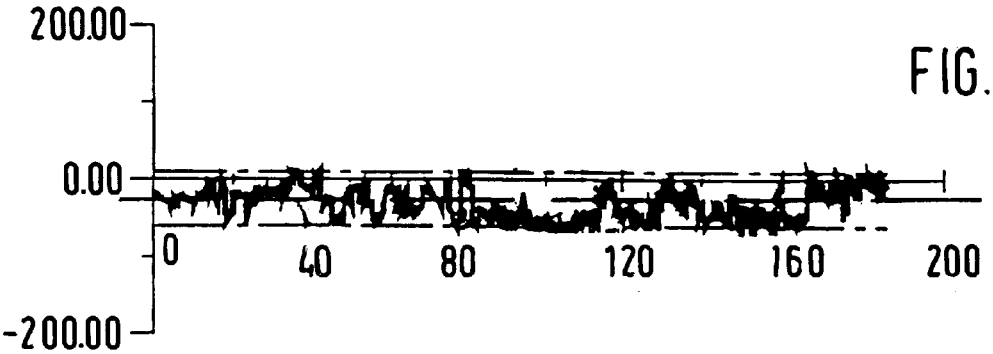
FIG. 7.4

FIG. 8.1
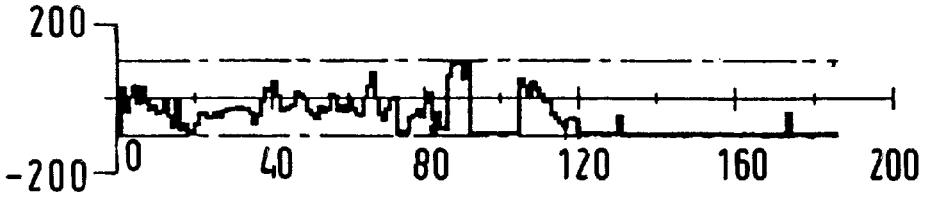
FIG. 8.2
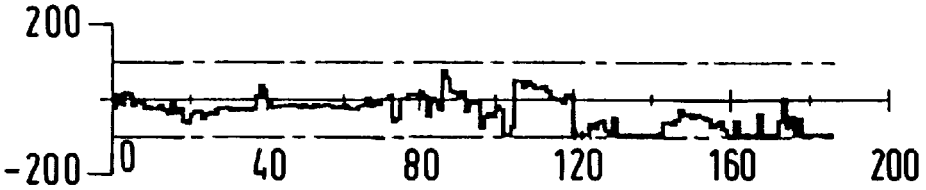
FIG. 8.3
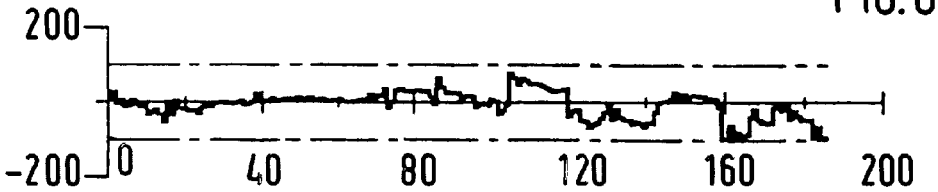
FIG. 8.4
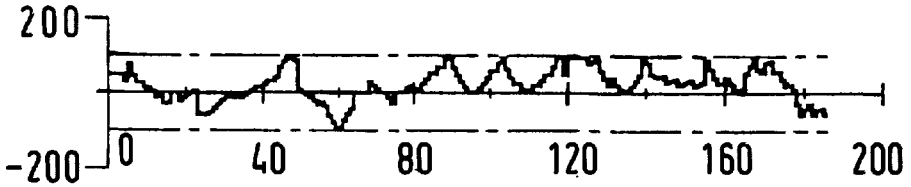
FIG. 8.5
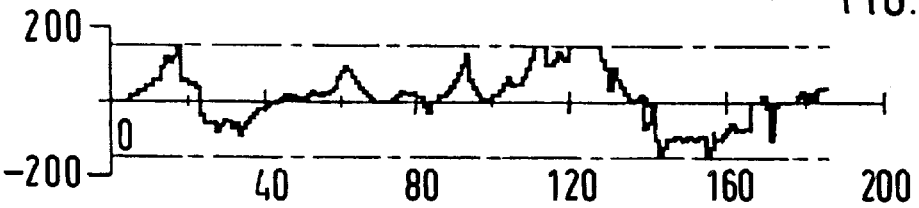
FIG. 8.6
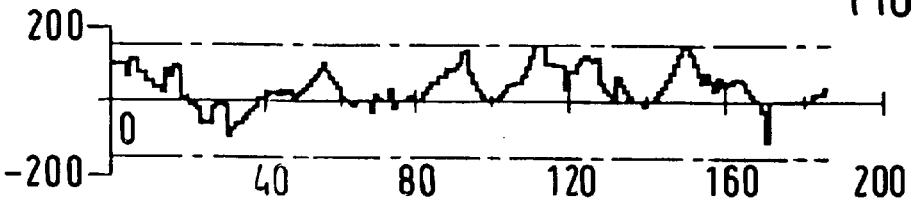

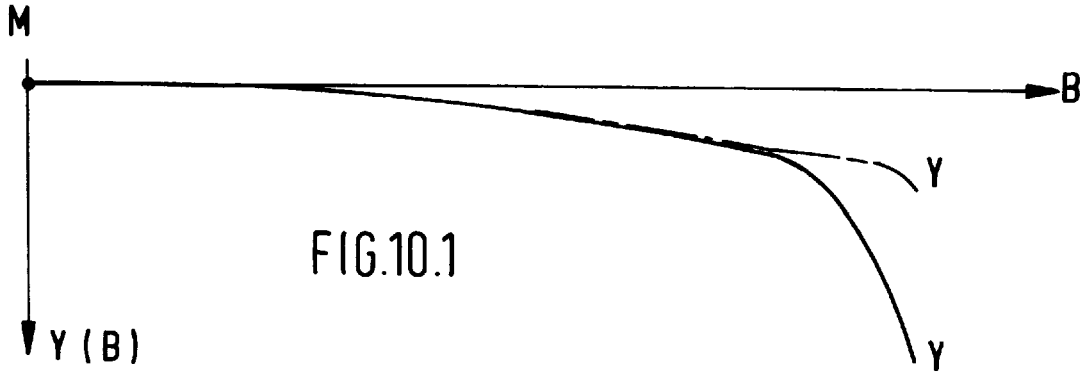
FIG.10.1
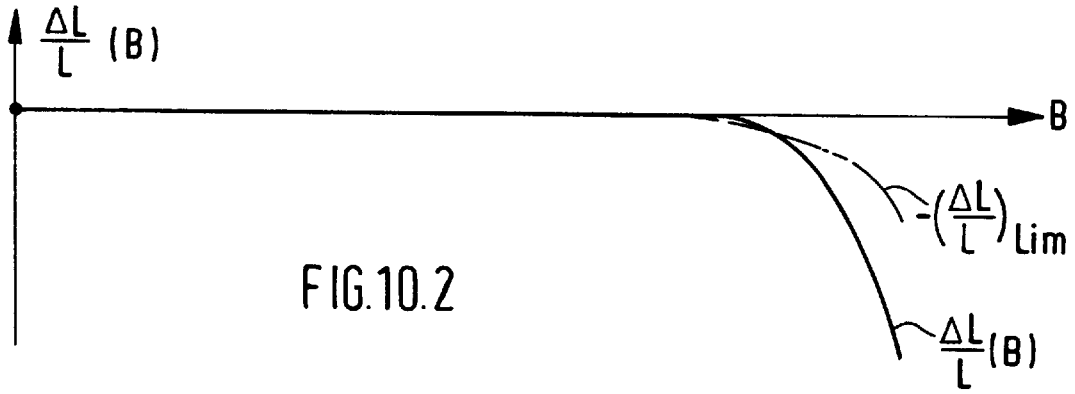
FIG.10.2
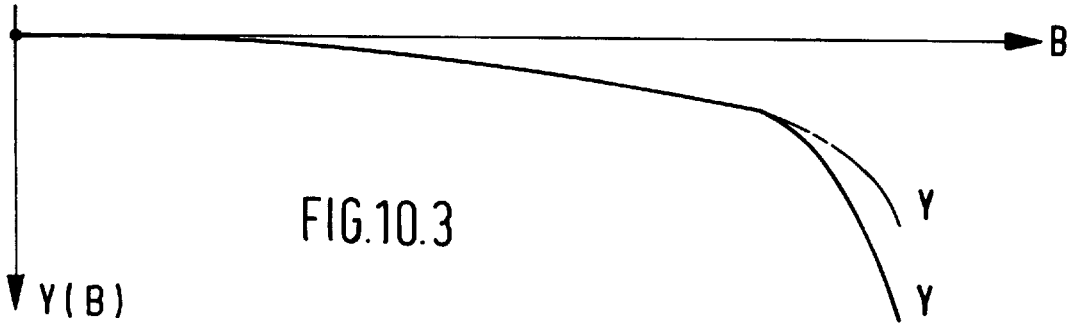
FIG.10.3
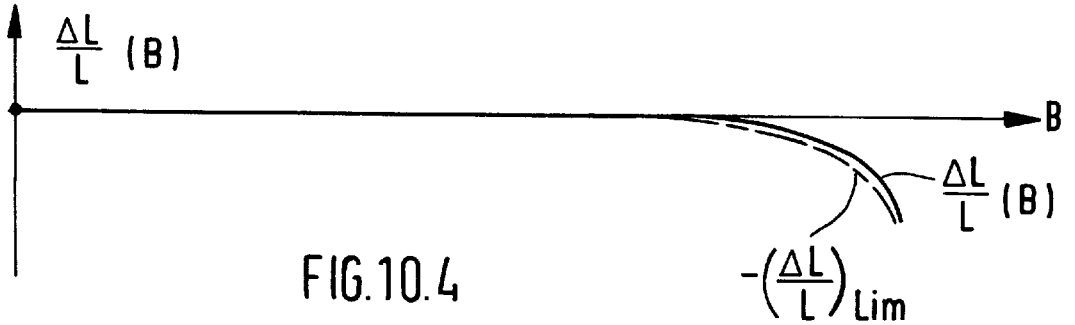
FIG.10.4

FIG.11.1
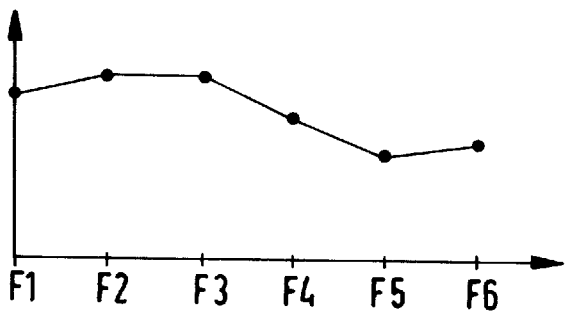
FIG.11.2
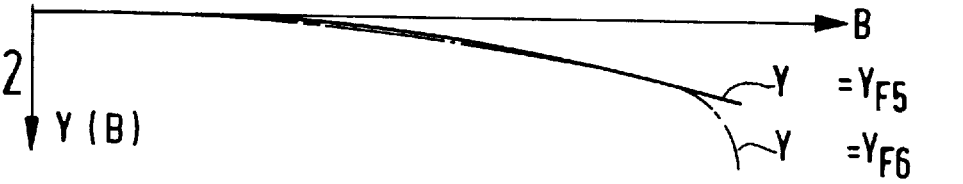
FIG.11.3
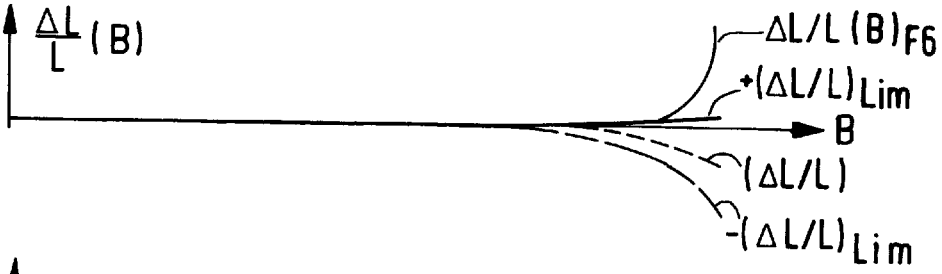
FIG.11.4
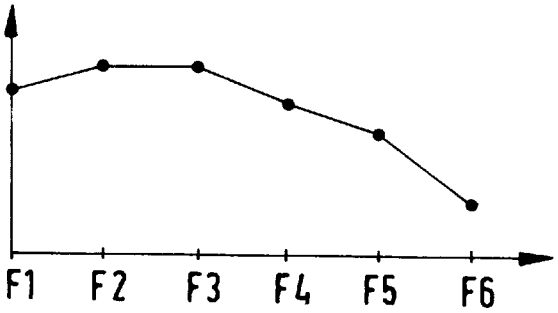
FIG.11.5
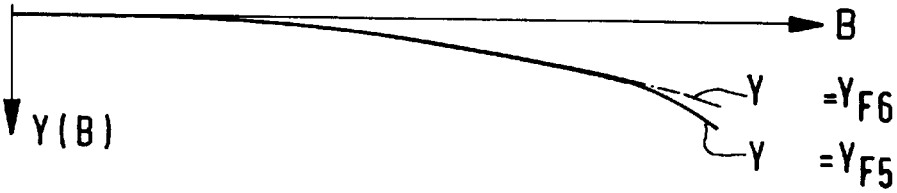
FIG.11.6
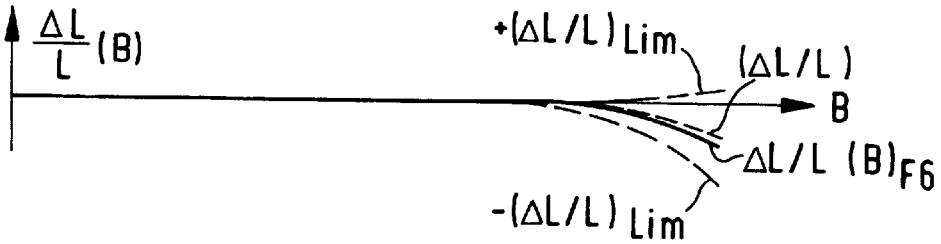

METHOD AND APPARATUS FOR ROLLING STRIP

BACKGROUND OF THE INVENTION

1. Field of the Invention

The present invention relates to a method and an apparatus for rolling strip in a strip rolling train having at least two roll stands, wherein each roll stand has horizontally adjustable upper and lower work rolls which either act alone (two-high stand) or which are each supported directly or through an intermediate roll by a back-up roll, or with a reversing stand in which at least two passes are rolled, wherein the strip is subjected in the roll stands to a structural or constitutional change, and wherein adjusting elements act on the strip for imparting a profile and surface evenness to the strip.

2. Description of the Related Art

In practice, continuously increasing demands are made of the surface evenness of the hot strip as well as of the surface evenness of the cold strip. Simultaneously, the boundary conditions for hot rolling become more and more difficult because increasingly thinner and wider products are demanded, which leads to greater reductions and increased rolling forces even in the rearward stands, i.e., the stands on the exit side of the train. With increasing reduction, the wear increases (CSP-plants) and the thermal crown increases with increasing train production, i.e., in the case of endless rolling or in a hot aluminum strip rolling train.

This means that there is an elementary technical and economical demand to maintain through an optimum presetting an improved evenness of the strip even under extreme boundary conditions and there is a corresponding demand for an improvement of the surface evenness of a rolled strip even within the train; this demand is dependent on the purpose of use and dependent on the processes to be taken into consideration when the hot strip is cooling on the run-out roller table and in the coil.

When hot rolling strip material, the thermal crown or camber and the wear of the work rolls and the elastic deformations thereof are subject to relatively great changes within a rolling program. Without carrying out corrections by means of adjusting elements, the roll contour changes within increasingly continuing rolling stock throughput. The effect is different from stand to stand and from pass to pass. Consequently, in addition to the strip contour, the predetermined surface evenness of the hot strip and, thus, the surface evenness of the cold strip also change.

When rolling in one width, a number of strips with equal widths or approximately equal widths are rolled successively within a rolling program. Simultaneously with the value of the strip profile predetermined for a certain point (for example, $C_{40}$ or $C_{25}$), the total shape of the strip profile changes and, thus, the predetermined surface evenness of the strip in the middle areas of the strip as well as especially also in the areas of the strip near the edges also changes. For example, the increasing drop of the thermal crown of the rolls or the wear of the work rolls in the areas near the edges result in undesired profile anomalies. These anomalies are increased thickness areas at the edges (beads), or, in contrast, decreased thickness areas at the edges. These types of profile anomalies substantially limit the rollable length within one width. In this regard, the rolling length within one width is defined as the sum of all strip lengths which are rolled in one width or with approximately equal widths.

DE 30 38 865 C1 discloses that changes of the thermal crown and of the wear of the work rolls can be compensated by means of suitable adjusting elements, such as displacement elements and/or bending elements, for example, continuously variable crown displacement, or by means of a suitable cooling.

For controlling the convexity and/or the edge drop of the strip, EP 0 276 743 B1 discloses adjusting the horizontal displacement of the work rolls and the bending forces acting on the work rolls of a group of roll stands located on the upstream side of a tandem rolling mill in accordance with the rolling conditions including the widths of the strips.

For controlling the wear and the thermal crown of the work rolls with the object of avoiding undesired profile shapes and surface unevenness, the work rolls of a group of roll stands on the downstream side are pushed back and forth within predetermined intervals. In this case, the rearward stands are displaced after each strip in opposite directions by a certain distance; once the displacement amount has reached a maximum value, the displacement direction is reversed. This cyclical displacement causes the wear of the work rolls to be uniform over a larger area.

EP 0 618 020 A1 discloses a method of rolling strip in a roll stand of the above-mentioned type with horizontally adjustable upper and lower work rolls, wherein adjusting elements act on the strip for influencing the profile and surface evenness of the strip. The known rolling method makes it possible in spite of flexible rolling programs to approximately meet the requirements with respect to profile accuracy and surface evenness of the strip when an intended or target contour of the profile of the strip is predetermined, wherein for achieving the intended contour successively two groups of adjusting elements act on the strip, and wherein a first group of adjusting elements are used and primarily the contour of the strip in the middle area thereof is influenced when the strip thickness is above the critical thickness, while a second group of adjusting elements are used when the strip thicknesses in the edge areas thereof are below the critical thickness.

However, the measures known in the prior art are not sufficient for meeting the increased demands particularly with respect to the surface evenness even under extreme boundary conditions. When producing hot strip, these boundary conditions concern the flexible setting up of rolling programs, wherein, in addition to increased thicknesses and material changes, especially with changes in the direction of narrow and wide are desired (mixed rolling). In addition, for economical reasons, the number of strips of equal width are to be increased within one rolling program without impairing the profile accuracy and surface evenness.

SUMMARY OF THE INVENTION

Therefore, it is the primary object of the present invention to provide a method and an apparatus of the above-mentioned type which in spite of flexible rolling programs are capable of meeting increased requirements with respect to surface evenness of the hot strip as well as the surface evenness of the cold strip and, in combination therewith, the profile accuracy, wherein the measures of the method proposed in accordance with the present invention are to produce through an optimum presetting an improvement of the surface evenness even within the train as well as an improved surface evenness of the strip even under extreme boundary conditions independently of the purpose of use and independently of the processes occurring during cooling of the hot strip on the run-out roller table and in the coil.

The method also is to be used in a cold train or cold roll stand. Also in this case, contour changes of the strip are carried out in the immediate strip edge area and a contour is desired which is as much edge-drop-free as possible, wherein the surface unevenness and strip tensions are to be kept within limits especially at the strip edge.

In accordance with the present invention, in a method of the above-described type for rolling a strip, at least in one strip area an intended surface unevenness shape is presupposed over the width of the strip, an actually achieved surface unevenness shape in this strip area is determined and is compared to the presupposed unevenness shape, a difference is computed between the unevenness shapes, and available mechanically or physically acting adjusting elements are operated in such a way that the difference is minimized as much as possible.

Accordingly, in accordance with the present invention, the method no longer starts from a desired surface evenness in relation to a reference point of the strip; rather, the invention presupposes an intended unevenness shape over the width of the strip, an actually achieved unevenness shape within a certain strip width is determined and compared to the presupposed unevenness shape, a difference is computed and available mechanically or physically acting adjusting elements are used in such a way that the difference is essentially minimized as much as possible.

Consequently, the method according to the present invention produces through an optimum presetting an improved strip evenness even under extreme boundary conditions.

All adjusting elements or parameters which influence the elastic behavior of the roll set can result in a strip elongation of the parabolic type over the width. Influencing variables which change the waviness or strip elongations particularly in the edge area, are the following:

wear of work rolls thermal crown (zone cooling, cover shells)

rolling force, for example, due to roll flattening special roll grind (anti-bead roll, tapered roll)

on-line work roll grinding device strip temperature changes at the edge (positive/negative)

strip edge lubrication

Depending on the requirements, adjusting elements with primarily parabolic effect or those having an effect of a higher degree in the areas of the edges are activated.

The method according to the present invention provides that an intended surface unevenness shape of the strip is presupposed in dependence on the purpose of use and on the processes occurring during cooling of the hot strip on the run-out roller table and in the coil. In this connection, it is not sufficient merely to presuppose an intended surface evenness value or intended surface unevenness value in relation to, for example, the $C_{40}$ point, but it is necessary to seek a strip elongation/strip length reduction over the width or a surface evenness of a higher degree.

For example, instead of or in addition to presupposing an intended surface evenness value or surface unevenness value of a profile, it is possible to presuppose intended stress distribution or intended elongations over the width and to compare these values with the actually achieved or computed stress distributions or elongations. The resulting differences are then computed and the adjusting elements are used in such a way that these differences are essentially minimized as much as possible.

The flow diagram of FIG. 12 shows the procedure to be carried out for determining the strip contour or strip contour change and, thus, the strip tension distribution over the width or the strip elongation over the width.

The method steps for producing a desired strip tension distribution or strip elongation over the width are illustrated in the flow diagram of FIG. 13.

In a hot rolling train for producing a strip which is planar in the cold state, different surface unevenness shapes are advantageously presupposed in the hot strip over the length of the strip.

For producing the intended different surface unevenness of the hot strip, work roll bending, PC stand adjusting angle, CVC displacement or other adjusting elements are changed over the strip length.

The method further provides that, when the differences are insufficiently minimized, the input conditions of the respective stand are changed and the result is optimized. In addition to mechanically acting adjusting elements, it is also possible to use physically acting adjusting elements. These elements can be changeably adjusted as preadjustment at the head as well as over the length of the strip. These adjustments concern, for example, strip edge cooling, strip edge heating, rolling force distribution or also strip edge lubrication.

For a better overview of the processes taking place and the changes in the state of the strip, the description of the target values as well as the actually achieved values is provided by dividing the strip width into a body area and an edge area. In this regard, the surface unevenness shape can be described by a polynom function $y^*=A_2x^2$ plus $A_4x^4$ plus $A_6x^6$ plus $A_nx^n$, wherein $y^*$ is the coordinate for the strip elongation, strip surface unevenness or strip tension and x represents the strip width coordinate.

In accordance with another advantageous embodiment of the method of the present invention, positive and negative limits are defined around the target or intended values (strip tension, surface evenness, strip elongation/strip shortening) and the adjusting elements are used in such a way that the strip tension distribution, the surface evenness distribution, distribution of strip elongation/shortening are within the limits.

In accordance with a preferred feature, for producing a strip elongation/strip shortening of a parabolic or higher order over the strip width, adjusting elements are used which influence the elastic behavior of the roll set, wherein these adjusting elements include axial displacement means for the CVC work rolls or bending devices for the rolls or a combination of both.

For avoiding earing of the hot strip or in the cold state of the strip, the present invention further provides to carry out a redistribution of the rolling force in such a way that the rolling force is reduced at least in the last stand and the rolling force of upstream stands is increased.

In accordance with another very advantageous feature, the processes occurring during cooling of the rolled strip on the run-out roller table as well as in the coil and the simultaneously occurring strip elongations or shortenings in the body area as well as in the area of the strip edges are analyzed and the determined or computed length changes are compensated by an appropriate presetting of the adjusting elements at least in the last stand.

Finally, a preferred feature of the present invention provides that mechanically acting adjusting elements are used and these mechanically acting adjusting elements are reinforced by non-mechanical adjusting elements, for example, positive or negative thermal adjusting elements.

The apparatus according to the present invention for carrying out the method described above includes within the rolling plant at least two or more of the adjusting elements mentioned below.

The adjusting elements may be axially displaceable CVC work rolls or work roll bending devices. In addition, the work rolls may be constructed so as to be capable of a crossed configuration. For thermally influencing the work rolls, the work rolls may be equipped, for example, with a thermal cover or possibly also with a zone cooling. Moreover, the work rolls may be provided with a special roll grind or they may be equipped with an on-line grinder. Furthermore, if it is necessary to carry out a thermal correction of the strip edge areas, the present invention provides that the apparatus includes a strip edge heating device in front of, within or following the finishing train, for example, in the area of the run-out roller table, or a strip edge cooling device in front of, within or following the finishing train. Finally, a strip edge lubricating device may be provided within the finishing train.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIGS. 2.1–2.5 are diagrams showing the determination of the strip elongation over the width of the strip;

FIGS. 3.1–3.2 are diagrams showing a rolling program with respect to width/thickness of the rolling stock;

FIGS. 5.1–5.6 are diagrams showing the influence of the anti-bead roll when pushing away strip beads in the edge area, concerning stands 1–6;

FIGS. 6.1 to 6.4 are diagrams showing surface evenness of a higher degree without using the method according to the invention;

FIGS. 7.1–7.4 are diagrams showing the introduction of surface evenness limits of a higher degree or a presupposed negative intended surface evenness of a higher degree in the area near the edge;

FIGS. 8.1–8.6 are diagrams showing the contour regulation by changing the displacement positions of CVC rolls, anti-bead rolls and conventional rolls;

FIGS. 10.1–10.4 are diagrams showing the influence of a tapered roll with or without taking into consideration surface evenness limits of a higher degree;

FIGS. 11.1–11.6 are diagrams showing the influence of a rolling force redistribution on the strip surface evenness shape or the shape of the strip elongation over the strip width;

DESCRIPTION OF THE PREFERRED EMBODIMENTS

Figure 1:
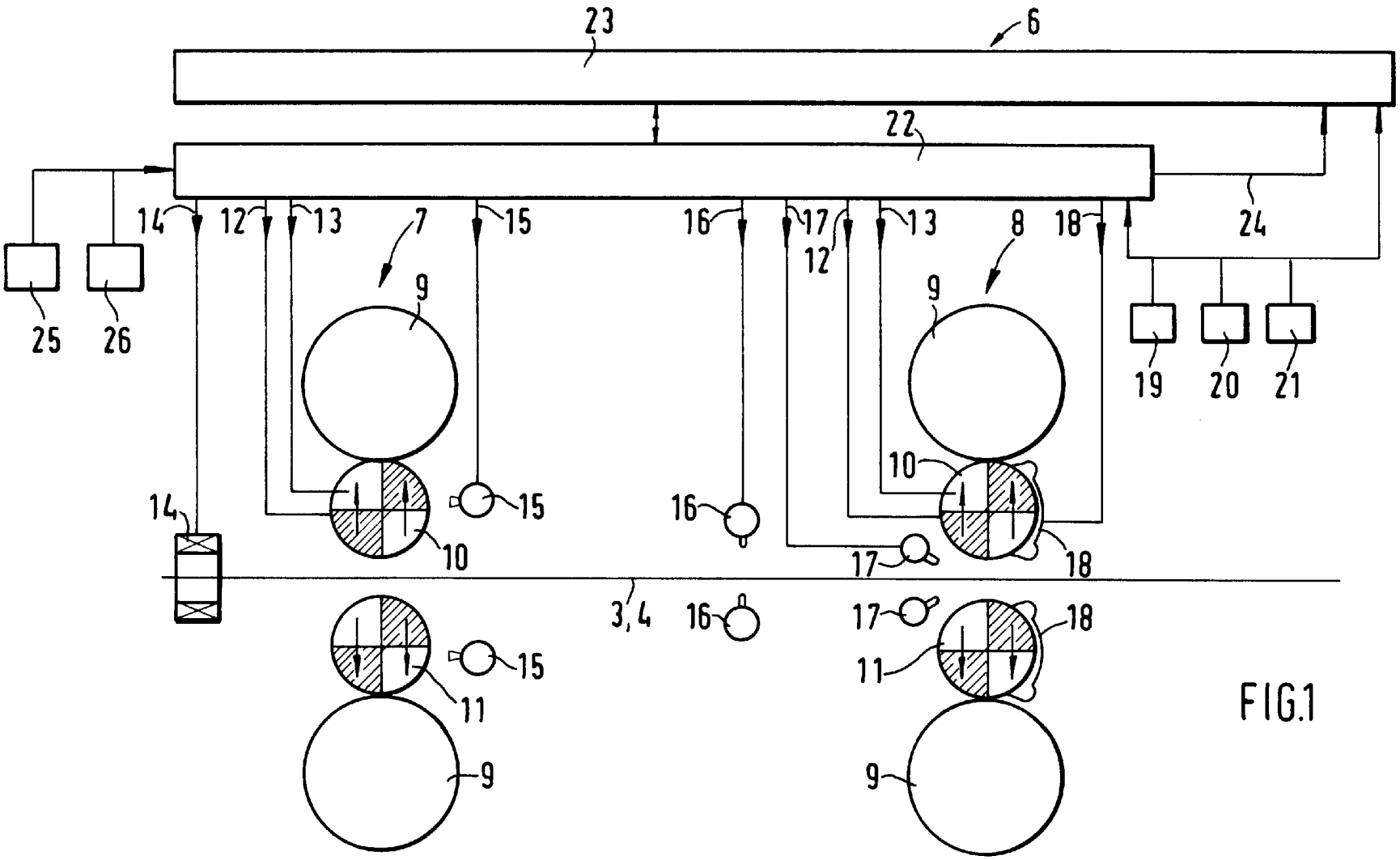
FIG. 1 is a schematic illustration of an apparatus for carrying out the method according to the present invention.

FIG. 1 is an illustration of a rolling train 6 for achieving presupposed or predetermined intended surface unevenness shapes over the width of a rolled strip 3,4, wherein the illustration is schematic in part and with only symbolic characterizations for the mechanical adjustment elements, including the supporting elements, as well as in the form of black boxes for computers and measuring devices.

The plant is composed of several roll stands, wherein only the first roll stand 7 and the last roll stand 8 are shown in the drawing. However, the rolling train may also be with a reversing stand in which several passes are rolled. Each roll stand 7, 8 has horizontally adjustable upper and lower work rolls 10, 11 which are supported by back-up rolls 9. The work rolls 10, 11 are axially displaceable, preferable with a CVC displacement 12, and are equipped with work roll bending devices 13. The work rolls 10, 11, provided with ground or thermal wear contour, are used by means of CVC displacement 12 and work roll bending 13 as mechanical adjusting elements either in the strip middle area or in the strip edge area.

For reinforcing these mechanical adjusting elements 12, 13, a strip edge heating unit 14 is arranged in front of or following the first stands of the finishing train for changing the edge heating of the rolled strip 3 or 4. For thermally influencing the strip shape through changes of the thermal crown of the work rolls 10, 11, the rolling train 6 is provided, preferably in the area of the front or rear roll stands, with a work roll zone cooling unit 15, for example, in the form of spray nozzles directed in the appropriate zones toward the work rolls 10, 11, as shown, for example, following the first roll stand 7. Also contributing to the thermal influence on the strip edges are strip edge cooling units 16 with spray nozzles, for examples, arranged in the side guide means as well as work roll cover shells 18, as illustrated, for example, at the last roll stand 8. The lubrication 17 of the work rolls 10, 11 in the strip edge area influences the load distribution in the roll gap and, thus, also influences the strip contour. For the permanent determination of the strip contour, arranged following the last roll stand 8 are measuring devices 19, 20, 21 for measuring the thickness, surface evenness and temperature of the strip.

The measuring devices 19, 20, 21 as well as 25, 26, and also indicating devices of the mechanical adjusting elements 12, 13 as well as the thermal and other influencing elements 14–18, are connected to a strip contour and surface evenness computer 22. Consequently, the determined measuring data, particularly for the profile and surface evenness or unevenness of the strip, 3,4, can be utilized directly for correcting the upstream control systems or adjusting elements, with the object of comparing the actually achieved surface unevenness shape of the strip with the values of the presupposed intended unevenness, computing a difference therefrom and utilizing the available mechanically or physically acting adjusting elements in such a way that the differences are minimized as much as possible, as prescribed by the teaching of the invention. In order to achieve optimum initial conditions for the profile and surface evenness computation, the incoming strip contour is preferably determined with the profile measuring device 25 and the incoming strip surface evenness shape is determined with the surface evenness measuring device 26. A pass schedule computer 23 supplies the strip contour and surface evenness computer 22 with input data. A data return 24 is provided for the purpose of the desired rolling force redistribution.

Figure 12:
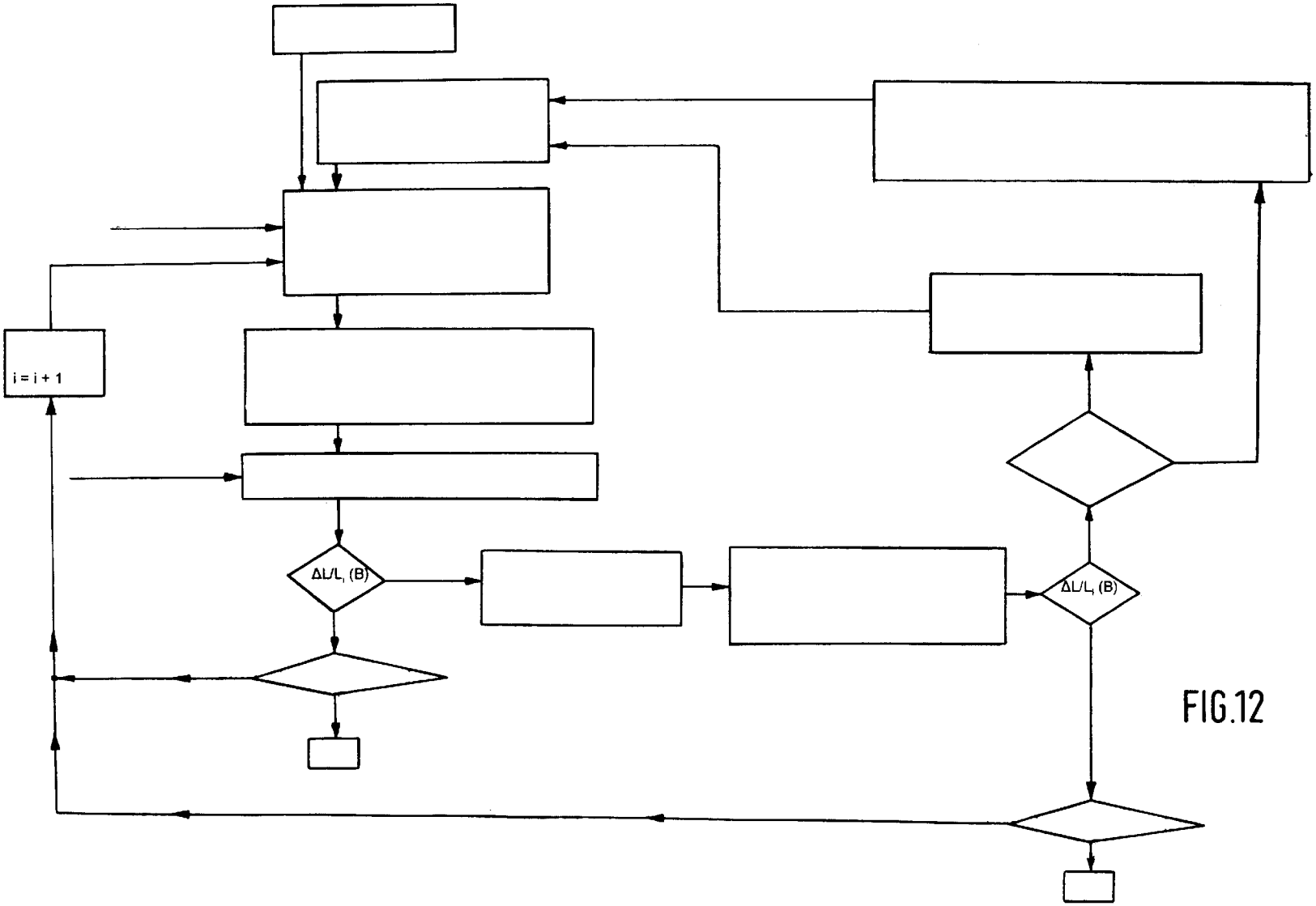
FIG. 12 is a flow diagram for producing a desired strip elongation over the width.

The manner of determining the strip contour or strip elongation $(\Delta L/L)_i$ (B) and, thus, the strip tension distribution $\sigma_i$ (B) over the width B is shown in FIGS. 2.1 to 2.5. The flow diagram of FIG. 12 shows the method steps for producing a presupposed intended surface unevenness or intended strip elongation over the width. In FIG. 2.1, the solid curve represents the incoming strip contour $y_{on}$ (B) and the dash-dot curve represents the exiting strip contour $y_{off}$ (B). FIG. 2.2 shows the difference between the entering and the exiting strip contour; FIG. 2.3 shows the strip elongation B with indication of the strip edge area a, wherein the remaining curve length indicates the so-called strip body area; K is the travel index over the strip width. The broken curves show the shape of the positive and negative surface evenness limit over the strip width. FIG. 2.4 shows the distribution of the strip elongation and the limits thereof in a parabolic portion and in FIG. 2.5 in a portion of a higher degree.

Figure 4:
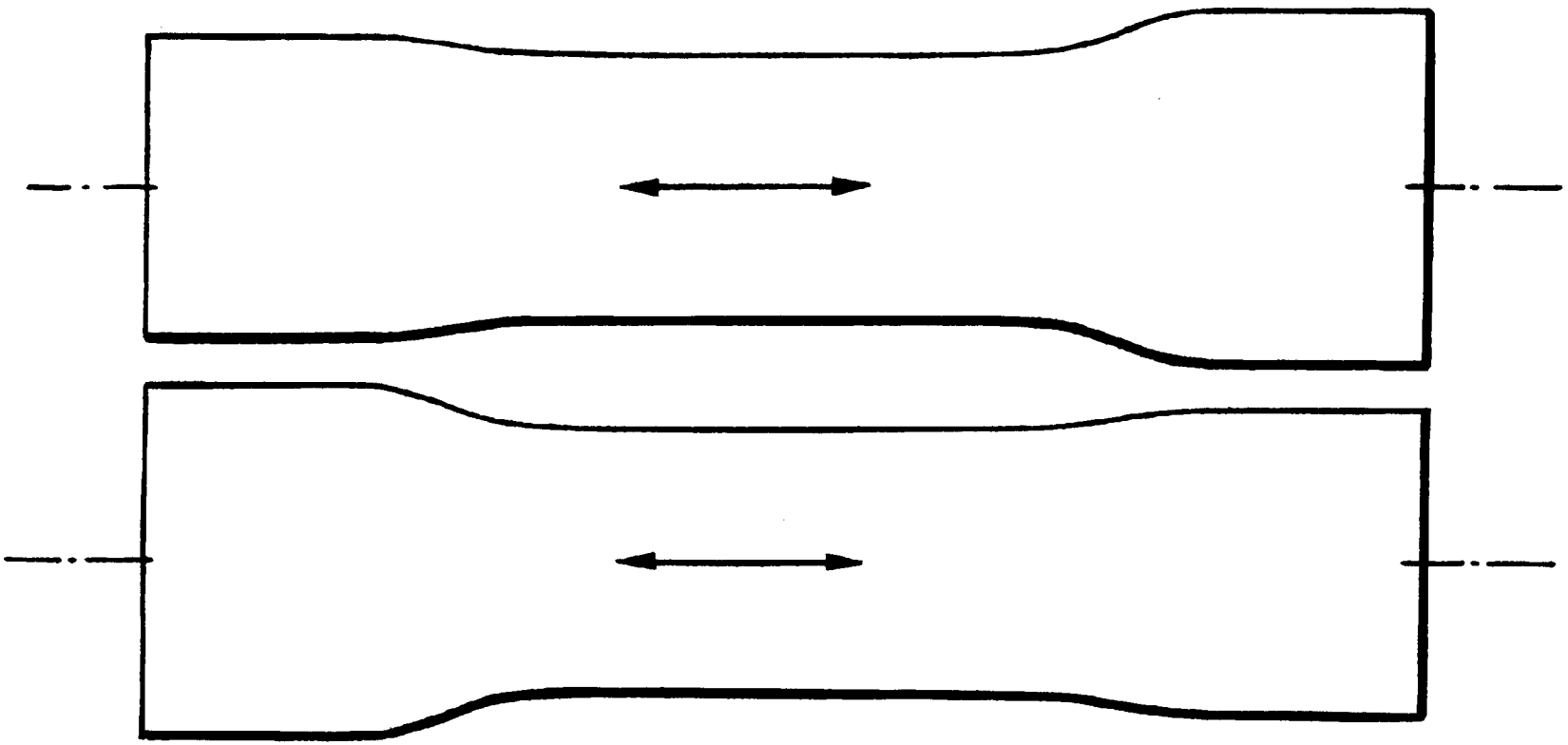
FIG. 4 is a schematic view showing the shape of an anti-bead roll in accordance with EP 0 67 471 A1.

FIG. 3.1 is a diagram showing a rolling schedule with respect to the width of the rolled strip. This includes a width difference during rolling of altogether about 185 coils between 1,000 and 2,000 mm in appropriately stepped width jumps. As a supplement, FIG. 3.2 shows within the same rolling schedule thickness jumps of the rolling stock between 1,600 and 3,600 micrometers with the same coil sequence. When rolling wider strips, for example, in accordance with the rolling program according to FIG. 3.1, FIG. 3.2, beads can be formed in the case of a short drawing sequence. These beads are successively pushed away by means of anti-bead rolls shown in FIG. 4.

The change of the strip contour becomes apparent when looking at FIGS. 5.3 and 5.4. This contour change leads to strip elongations, particularly in the strip edge area which is shown in FIGS. 6.1 to 6.4 for the stands 3–6, wherein the surface evenness of a higher degree is indicated on the ordinate and the coil number on the abscissa. FIGS. 5.4 and 6.2, particularly in the area of the coils 20 to 80, clearly show the strip contour change resulting from the use of the anti-bead roll.

In addition, the wear of the work rolls and the thermal crown of the work rolls may lead to undesired strip elongations or strip shortenings. Consequently, limits have to be introduced for limiting the strip elongation or surface evenness limits, also of a higher degree, have to be introduced. The use of such surface evenness limits is apparent, for example, from FIGS. 7.1 to 7.4 for the stands F3 to F6, as indicated in dash-dot lines. FIGS. 8.1 to 8.6 show the adjusted displacement positions of the stands F1 to F6 with CVC rolls, anti-bead rolls and conventional rolls for the purpose of optimizing the strip contour and the strip surface evenness. For the stand of FIG. 7.4 on the exit side, negative intended service evenness of a higher degree was presupposed for the strip edge. As is apparent particularly from the diagram 7.4, this successfully counteracts waves of a higher degree, for example, earing at the strip edge, in the hot as well as in the cold state of the strip.

Figure 9:
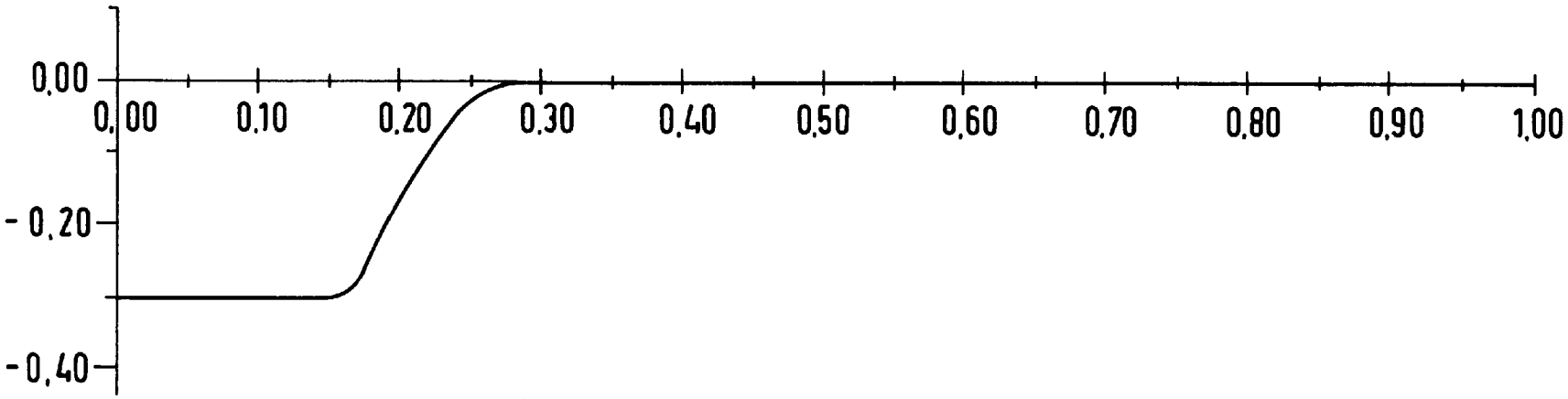
FIG. 9 is a diagram showing the shape of a tapered roll.

Another adjusting element for use in the contour regulation is shown in FIG. 9. FIG. 9 show the shape of a tapered roll, wherein the abscissa indicates the axial length and the ordinate indicates diameter difference.

The effect of the tapered roll on the strip contour and the surface evenness shape or the shape of the strip elongation are illustrated in FIGS. 10.1 to 10.4. In the example of 10.1, it was possible to produce the desired strip contour, however, unduly short strip fibers in the edge area in accordance with FIG. 10.2 were the result. The danger that the strip will tear is very high because of the high tensile stress at the edge. For avoiding this problem, surface evenness limits of a higher degree were introduced.

In accordance with FIG. 10.3, the desired strip contour is not as flat because the generated surface evenness shape according to FIG. 10.4 was kept within the permissible limits. When optimizing the displacement position for the purpose of improving the surface evenness of a higher degree, for example, bending is used for ensuring the body surface evenness.

Surface evenness limit lines are advantageously placed around the intended surface evenness of a higher degree. These limit lines have the purpose of counteracting the expected earing of the strip edges during cooling of the strip or coil and to of ensuring a safe transport of the strip in the train.

Earing frequently occurs within the train. The reason for this in many cases is a rolling force which is too high, for example, in accordance with FIG. 11.1 to 11.3 at stand F6.

The rolling force level frequently does not drop from stand to stand, but remains constant or even increases slightly in accordance with FIG. 11.1 at F6. Particularly in the case of thin strips, this leads to long strip edges, as indicated in FIG. 11.3.

The intended surface evenness shape $(\Delta L/L)_{int}$ in and the surface evenness limits $(\Delta L/L)_{lim}$ are also illustrated in FIG. 11.3. When this process takes place in a hot rolling train in which the strip edges naturally are somewhat colder, the situation becomes worse during the cooling process of the hot strip in the coil. The situation is improved by a rolling force redistribution, for example, while reducing the rolling force at F6 and increasing the force at F4/F5 in accordance with FIGS. 11.4 to 11.6.

A resulting change of the body surface unevenness can be compensated by the adjusting elements, i. e., work roll bending or CVC rolls. By analyzing the cooling process of the hot strip on the run-out roller table and in the coil, it is possible to determine the intended strip elongations for the hot strip over the width in order to improve the cold strip surface evenness in accordance with these determinations. The manner of carrying these steps is illustrated in the flow diagram of FIG. 13.

The manner in which the rolling force redistribution is incorporated into the total iteration schedule is shown in FIG. 12.

While specific embodiments of the invention have been shown and described in detail to illustrate the inventive principles, it will be understood that the invention may be embodied otherwise without departing from such principles.

I claim:

1. A method of hot rolling strip in a hot strip rolling train having at least two roll stands, each roll stand having horizontally adjustable upper and lower work rolls, wherein the work rolls act alone as a two-high stand or each work roll is supported directly or through an intermediate roll by a back-up roll, or in a reversing stand in which at least two passes are rolled, wherein the hot strip is subjected in the roll stands to a constitutional change, and wherein adjusting elements act on the strip for imparting a profile and surface evenness to the strip, the method comprising presupposing in at least one strip area an intended surface unevenness shape over a width of the strip, determining an actually achieved surface unevenness shape in the strip area and comparing the actually achieved surface unevenness shape to the presupposed unevenness shape, computing a difference between the unevenness shapes, and operating the adjusting elements such that the difference is minimized, the intended hot strip unevenness leading, after cooling of the strip, to a desired cold strip evenness.

2. The method according to claim 1, comprising, in addition to presupposing an intended surface unevenness shape, presupposing a profile of intended tension distributions or intended elongations of the strip over the width thereof, comparing the intended tension distributions or intended elongations with actually achieved tension distributions or elongations, computing differences between the tension distributions and the elongations and utilizing the adjusting elements such that the differences are minimized.

3. The method according to claim 1, comprising, for producing a planar strip in a cold state, presupposing in the hot strip different surface unevenness shapes over the length of the strap.

4. The method according to claim 1, comprising, when a result of the minimization of the difference is insufficient, changing input conditions in the form of properties of the entering strip including strip contour, surface evenness shape and strip temperature distribution of the respective stand, and optimizing the result.

5. The method according to claim 1, comprising, for producing different strip surface unevenness shapes, adjusting work roll bending, PC stand adjusting angle, CVC displacement or additional mechanically or physically acting adjusting elements over the strip length so as to be constant or changeable.

6. The method according to claim 1, comprising carrying out description of intended values, surface unevenness shapes and mathematical evaluation by dividing the strip width into a body portion and an edge portion.

7. The method according to claim 1, comprising describing the surface unevenness shape by a polynom function $y^*=A_2x^2+A_4x^4+A_6x^6+A_nx^n$, wherein $y^*$ is a coordinate for strip elongation, strip surface unevenness or strip tension and x is a strip width coordinate.

8. The method according to claim 1, comprising alternatively describing the surface unevenness shape as a sequence of points.

9. The method according to claim 1, comprising describing the intended value for the surface unevenness shape by a polynom function $y^*=A_2x^2+A_4x^4+A_6x^6+A_nx^n$, or a sequence of points.

10. The method according to claim 1, comprising defining around intended values positive and negative limits of strip tension, surface evenness, strip elongation, strip shortening, and utilizing the adjusting elements such that strip tension distribution, surface evenness distribution, strip elongation distribution, strip shortening distribution are within the limits or exceeding of the limits is minimized.

11. The method according to claim 10, comprising describing the limits for a permissible surface unevenness shape by a polynom function $y^*=A_2x^2+A_4x^4+A_6x^6+A_nx^n$, or as a sequence of points.

12. The method according to claim 10, comprising providing different shapes and levels for the intended surface unevenness shapes and the evenness limits over the width of a strip for different stands or passes.

13. The method according to claim 10, comprising utilizing adjusting elements which influence the elastic behavior of the rolls for producing a strip elongation or strip shortening of a parabolic type or of a higher degree over the strip width, wherein the adjusting elements comprise one or both of axial displacement means for the work rolls or bending devices for the work rolls.

14. The method according to claim 1, comprising, for avoiding earing of the hot strip or in the cold state of the strip, carrying out a distribution of rolling forces such that the rolling force is reduced at least in a last stand and the rolling force is increased in stands upstream of the last stand.

15. The method according to claim 1, comprising analyzing processes occurring during cooling of the strip on a run-out roller table and in a coil and simultaneously strip elongations or shortenings in a body portion as well as in strip edge portions, and compensating determined length changes by an appropriate presetting of the adjusting elements at least in the last stand.

16. The method according to claim 1, comprising using mechanically acting adjusting elements and non-mechanical adjusting elements including positive or negative thermal adjusting elements for supporting the mechanically acting adjusting elements.

17. The method according to claim 1, comprising comparing the measured surface unevenness shape with the intended evenness shape and utilizing the difference for adaptation purposes.

18. The method according to claim 1, comprising analyzing the difference between the determined surface unevenness shape and the intended evenness shape and dividing the difference into parabolic and portions of higher degree, and utilizing the adjusting elements accordingly in accordance with their effect.

* * * * *

UNITED STATES PATENT AND TRADEMARK OFFICE

CERTIFICATE OF CORRECTION

PATENT NO. : 5,970,765
DATED : October 26, 1999
INVENTOR(S) : Jürgen Seidel

Figure 13:
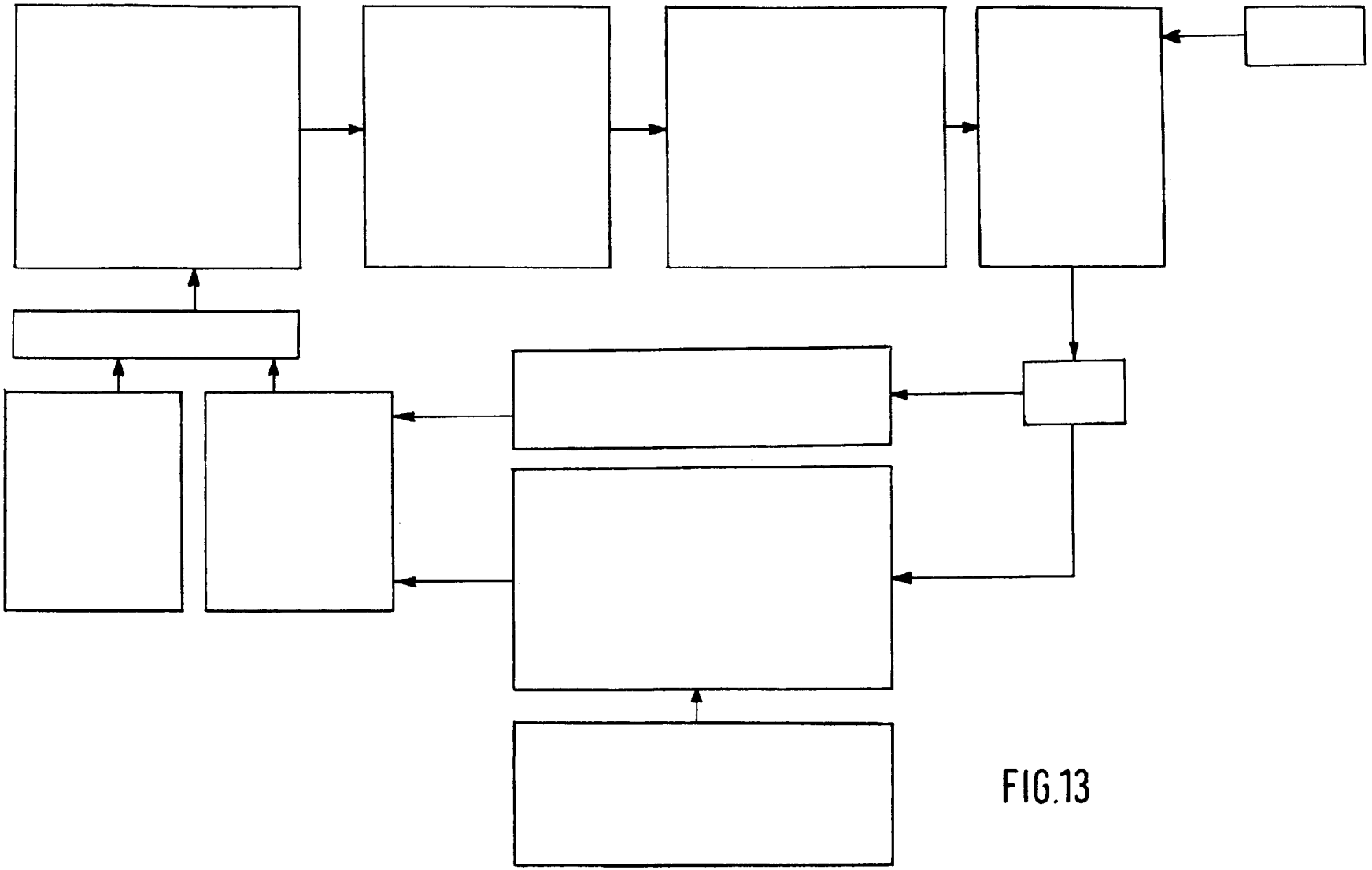
FIG. 13 is a flow diagram for generating cold strip surface unevenness or for reducing cold strip surface unevenness.
Figure 12:
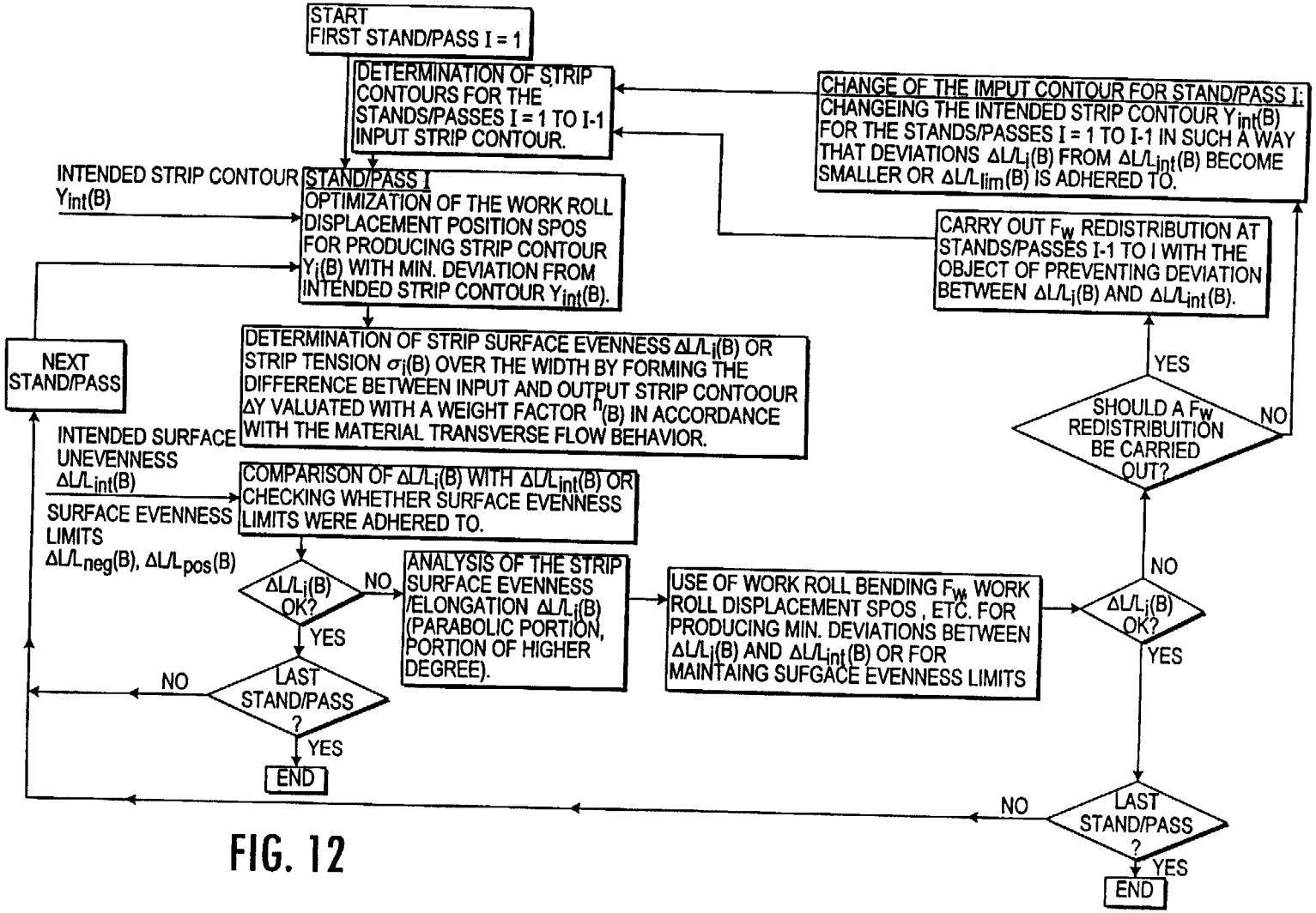
Figure 13:
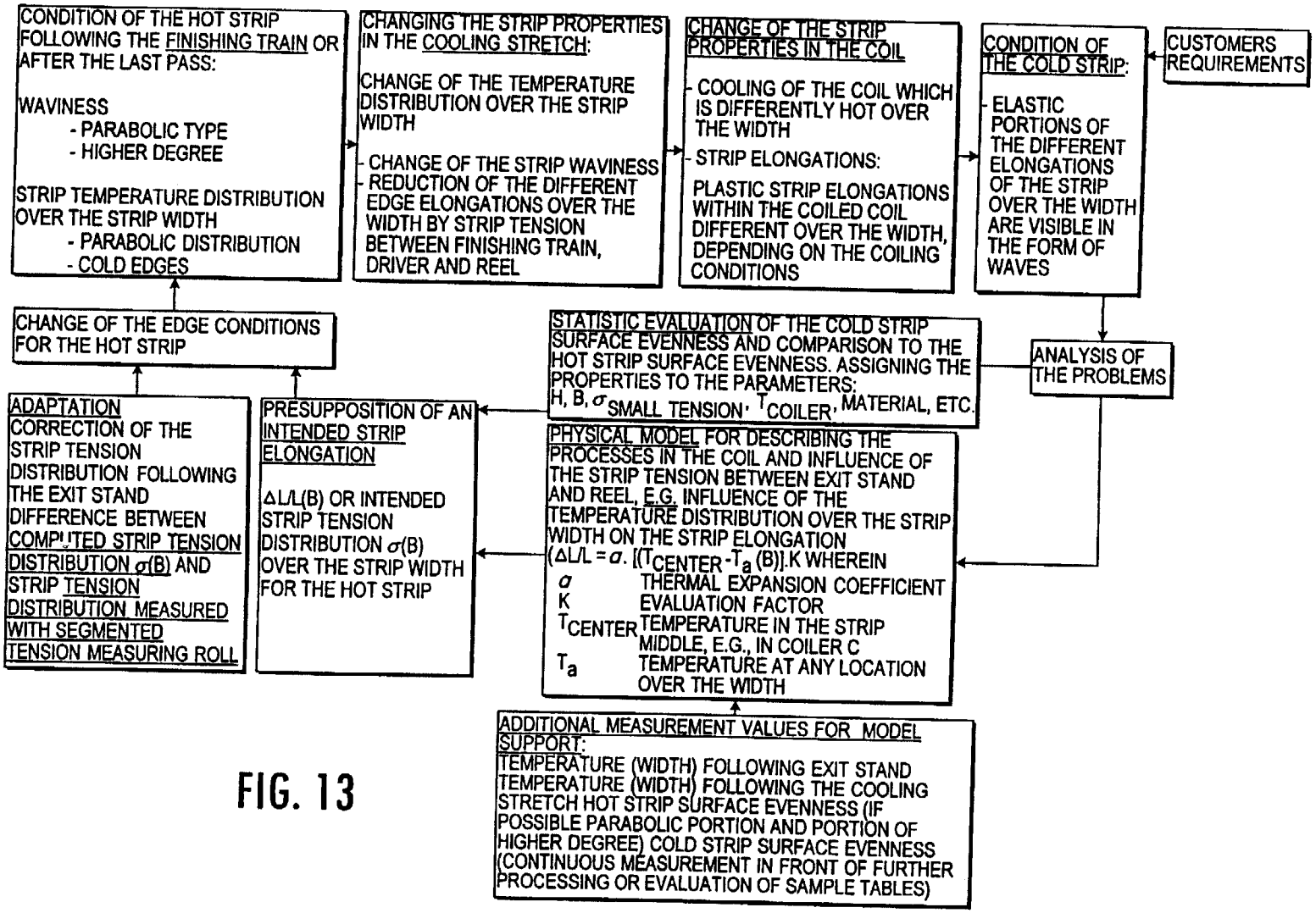

It is certified that error appears in the above-identified patent and that said Letters Patent is hereby corrected as shown below:

Drawings,

Sheets consisting of Figs. 12 and 13, should be deleted to be replaced with the drawing sheets, consisting of Figs. 12 and 13, as shown on the attached pages.

Signed and Sealed this

Ninth Day of October, 2001

*Attest:*

Nicholas P. Godici

*Attesting Officer*

NICHOLAS P. GODICI
*Acting Director of the United States Patent and Trademark Office*